US009779930B2

(12) United States Patent
Guna

(10) Patent No.: US 9,779,930 B2
(45) Date of Patent: Oct. 3, 2017

(54) MULTIPLEXED ELECTROSTATIC LINEAR ION TRAP

(71) Applicant: DH Technologies Development Pte. Ltd., Singapore (SG)

(72) Inventor: Mircea Guna, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/107,177

(22) PCT Filed: Dec. 6, 2014

(86) PCT No.: PCT/IB2014/002677

§ 371 (c)(1),
(2) Date: Jun. 22, 2016

(87) PCT Pub. No.: WO2015/104573

PCT Pub. Date: Jul. 16, 2015

(65) Prior Publication Data

US 2016/0336165 A1 Nov. 17, 2016

Related U.S. Application Data

(60) Provisional application No. 61/924,656, filed on Jan. 7, 2014.

(51) Int. Cl.
*H01J 49/42* (2006.01)
*H01J 49/26* (2006.01)
(Continued)

(52) U.S. Cl.
CPC ..... *H01J 49/4245* (2013.01); *H01J 49/0031* (2013.01); *H01J 49/027* (2013.01);
(Continued)

(58) Field of Classification Search
CPC .. H01J 49/0027; H01J 49/0031; H01J 49/025; H01J 49/027; H01J 49/42; H01J 49/4225; H01J 49/4245; H01J 49/063
See application file for complete search history.

(56) References Cited

U.S. PATENT DOCUMENTS 6,888,130 B1 * 5/2005 Gonin ..... H01J 49/027 250/281
2003/0089846 A1 * 5/2003 Cooks ..... H01J 49/0013 250/281
(Continued)

OTHER PUBLICATIONS

International Search Report and Written Opinion for PCT/IB2014/002677, mailed Apr. 17, 2015.
(Continued)

*Primary Examiner* — David E Smith
(74) *Attorney, Agent, or Firm* — John R. Kasha; Kelly L. Kasha; Kasha Law LLC

(57) ABSTRACT

Systems and methods are provided for performing multiplex electrostatic linear ion trap mass spectrometry. A first beam of ions is received and the first beam is split into N beams of ions using a beam splitter. N is two or more. Ions are received from only one of the N beams of ions at each entrance aperture of N entrance apertures of an electrostatic linear ion trap (ELIT). Ions from each entrance aperture of the N entrance apertures are trapped in separate linear flight paths using the ELIT, producing N separate linear flight paths. Ion oscillations in the N separate linear flight paths are measured at substantially the same time using the ELIT. The ELIT uses two concentric mirrors with N apertures to trap ions in the N separate linear flight paths. The ELIT uses an image current detector with N apertures to the measure the ion oscillations.

18 Claims, 5 Drawing Sheets

(51) Int. Cl.

| | |
|---|---|
| ***H01J 49/28*** | (2006.01) |
| ***H01J 49/00*** | (2006.01) |
| ***H01J 49/02*** | (2006.01) |
| ***H01J 49/06*** | (2006.01) |

(52) U.S. Cl.
CPC ..... *H01J 49/063* (2013.01); *H01J 49/26* (2013.01); *H01J 49/282* (2013.01)

(56) References Cited

U.S. PATENT DOCUMENTS

| | | | | |
|---|---|---|---|---|
| 2008/0067342 | A1 | 3/2008 | Ding | |
| 2009/0294655 | A1* | 12/2009 | Ding ..... | H01J 49/004 250/283 |
| 2010/0084549 | A1 | 4/2010 | Ermakov et al. | |
| 2013/0313425 | A1 | 11/2013 | Verenchikov | |

OTHER PUBLICATIONS

D. Zaifman et al. "High Resolution Mass Spectrometry Using a Linear Electrostatic Ion Beam Trap," International Journal of Mass Spectrometry 229 (2003), Aug. 10, 2006.

* cited by examiner

200

300

MULTIPLEXED ELECTROSTATIC LINEAR ION TRAP

CROSS REFERENCE TO RELATED APPLICATION

This application claims the benefit of U.S. Provisional Patent Application Ser. No. 61/924,656, filed Jan. 7, 2014, the content of which is incorporated by reference herein in its entirety.

INTRODUCTION

Spectral resolution in electrostatic linear ion traps (ELITs) is, in general, influenced by Coulomb interaction between the ions that oscillate back and forth between two concentric mirrors. Coulomb interactions, however, sometimes produce deleterious effects referred to as space charge effects. For example, spectral peaks of ions of a specific mass-to-charge ratio $(m/z)_0$ tend to broaden in the presence of large populations of ions of m/z significantly different from $(m/z)_0$. Also, when two large populations of ions of m/z, $(m/z)_1$ and $(m/z)_2$, that are close in the m/z space ($(m/z)_1 \approx (m/z)_2$) are present in ELITs the peaks tend to coalesce and the peaks cannot be resolved.

SUMMARY

A mass analyzer is disclosed for performing multiplex electrostatic linear ion trap mass spectrometry. The mass analyzer includes a beam splitter and an electrostatic linear ion trap with N entrance apertures. The beam splitter receives a beam of ions and splits the beam into N beams of ions. N is two or more. The electrostatic linear ion trap receives ions from only one of the N beams of ions at each entrance aperture of the N entrance apertures. The electrostatic linear ion trap traps ions from each entrance aperture of the N entrance apertures in separate linear flight paths, producing N separate linear flight paths. The electrostatic linear ion trap measures ion oscillations in the N separate linear flight paths at substantially the same time.

A method is disclosed for performing multiplex electrostatic linear ion trap mass spectrometry. A first beam of ions is received. The first beam is split into N beams of ions using a beam splitter. N is two or more. Ions from only one of the N beams of ions are received at each entrance aperture of N entrance apertures of an electrostatic linear ion trap. Ions from each entrance aperture of the N entrance apertures are trapped in separate linear flight paths using the electrostatic linear ion trap, producing N separate linear flight paths. Ion oscillations in the N separate linear flight paths are measured at substantially the same time using the electrostatic linear ion trap.

BRIEF DESCRIPTION OF THE DRAWINGS

The skilled artisan will understand that the drawings, described below, are for illustration purposes only. The drawings are not intended to limit the scope of the present teachings in any way.

Figure 1:
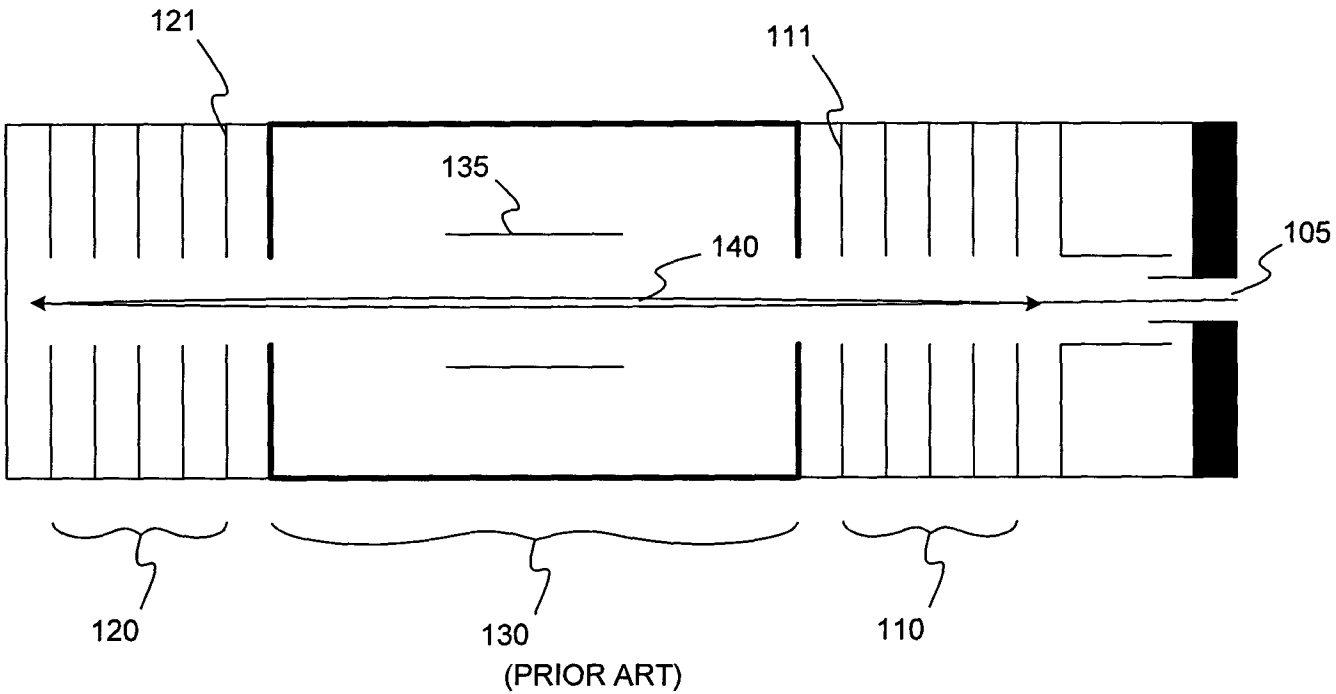
FIG. 1 is a cross-sectional side view of a conventional electrostatic linear ion trap (ELIT).

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

As described above, spectral resolution in electrostatic linear ion traps (ELITs) is, in general, influenced by Coulomb interactions among ions that oscillate back and forth between two concentric mirrors. Coulomb interactions, however, sometimes produce deleterious effects referred to as space charge effects. These space charge effects can result in the broadening of measured spectral peaks or in coalesced or convolved measured spectral peaks.

In various embodiments, the space charge effects of Coulomb interactions are reduced by configuring an ELIT to perform multiplex analysis. Multiplex analysis involves splitting a beam of ions produced from a sample into two or more beams. The two or more beams of ions are then analyzed by an ELIT at the same time in parallel. By splitting the beam of ions produced from a sample into two or more oscillating beams in the ELIT, the number of ions in each oscillating beam is reduced. Reducing the number of ions in each oscillating beam reduces the space charge effects.

In various embodiments, an ELIT analyzes two or more oscillating beams using the same two concentric mirrors and image current detector. In other words, the two concentric mirrors are configured to have two or more linear pathways to reflect two or more oscillating beams at the same time. Similarly, the image current detector is configured to have two or more linear pathways to detect the ion current of two or more oscillating beams at the same time. The two or more linear pathways of the two concentric mirrors and the image current detector produce a pepper pot design in cross-sectional view of these devices, for example. In addition, by using the same two concentric mirrors to reflect two or more oscillating beams the same one or more power supplies can be used. Using the same two concentric mirrors, the same image current detector, and the same power supplies for all beams reduces the complexity of the ELIT.

FIG. 1 is a cross-sectional side view of a conventional ELIT 100. ELIT 100 includes entrance port or aperture 105, first concentric reflector or mirror 110, image charge or current detector 135, and second concentric reflector or mirror 120. First concentric mirror 110, image current detector 135, and second concentric mirror 120 are aligned linearly with entrance aperture 105 to provide linear flight path 140. ELIT 100 receives a beam of ions through aperture 105. The beam of ions is initially accelerated by first concentric reflector or mirror 110. First concentric mirror 110 includes a set of electrodes or lenses. Electrode 111 is an exemplary electrode of first concentric mirror 110.

Ions accelerated by first concentric mirror 110 travel to second concentric mirror 120 through oscillation region 130 along flight path 140. Second concentric mirror 120 also includes a set of electrodes or lenses. Electrode 121 is an exemplary electrode of second concentric mirror 120. Second concentric mirror 120 reflects the ions it receives back through oscillation region 130 to first concentric mirror 110, which, in turn reflects the ions it receives. As a result, first concentric mirror 110 and second concentric mirror 120 cause ions to oscillate back and forth in oscillation region 130, reflecting back and forth between the arrows of flight path 140. Voltages are applied to the electrodes of first concentric mirror 110 and second concentric mirror 120 using one or more power supplies (not shown).

Image charge or current detector 135 senses the oscillations of ions in region 130. Image current detector 135 is, for example, a ring or tube shaped pickup electrode. Oscillation frequencies are calculated from the oscillations sensed by image current detector 135 using a processor. The oscillation frequencies are calculated using a Fourier transform, for example. From the oscillation frequencies the processor can calculate the masses or mass-to-charge ratios of the ions. The oscillating ions in oscillation region 130 induce an image current on image charge or current detector 135. Ions of only one m/z generate a sine wave signal, for example. A Fourier transform of the image current is used, for example, to obtain individual frequencies of different m/z.

Figure 2:
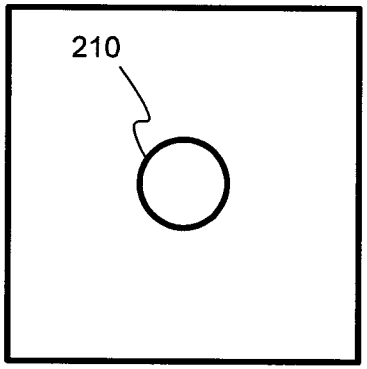
(PRIOR ART) FIG. 2
FIG. 2 is a cross-sectional front view of an electrode of a concentric mirror of a conventional ELIT.

FIG. 2 is a cross-sectional front view of an electrode 200 of a concentric mirror of a conventional ELIT. Electrode 200 is a plate with aperture 210. Ions pass through aperture 210 as they are reflected. Electrode 200 can be electrode 111 or electrode 121 of FIG. 1, for example.

Multiplex ELIT

Figure 3:
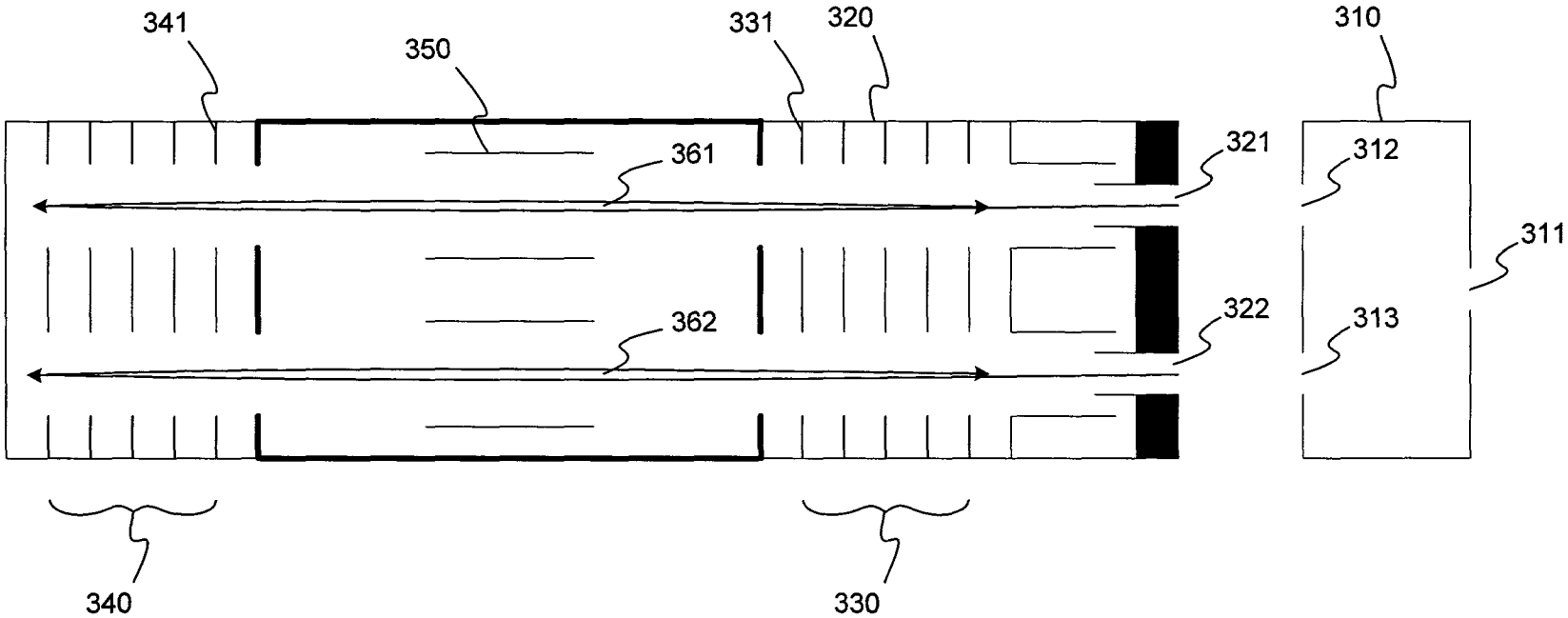
FIG. 3 is a cross-sectional side view of a mass analyzer for performing multiplex electrostatic linear ion trap mass spectrometry, in accordance with various embodiments.

FIG. 3 is a cross-sectional side view of a mass analyzer 300 for performing multiplex electrostatic linear ion trap mass spectrometry, in accordance with various embodiments. Mass analyzer 300 includes beam splitter 310 and ELIT 320.

Beam splitter 310 receives a beam of ions at entrance aperture 311. Beam splitter 310 splits the beam into N beams of ions. Beam splitter 310 splits the beam into N beams of ions so that the number of ions in each of the N beams of ions is less than the number of ions in the original beam. Decreasing the number of ions in each of the N beams of ions as compared to the original beam reduces the space charge effects in ELIT 320.

In the cross-sectional side view of FIG. 3, only two exit apertures 312 and 313 of Beam splitter 310 are shown. However, beam splitter 310 includes N exit apertures to eject the N beams of ions. N is two or more. N can be 2, 3, 4, 5, 6, 7, 8, 9, 10, 11, 12, 13, 14, 15, or 16, for example.

Beam splitter 310 is shown in FIG. 3 as a device separate from ELIT 320. One of ordinary skill in the art can appreciate that beam splitter 310 can also be part of ELIT 320.

Beam splitter 310 is shown in FIG. 3 as simply splitting a beam of ions into N beams of ions. In various embodiments, beam splitter 310 can also perform other mass analysis functions such as fragmentation, for example. In various embodiments, beam splitter 310 is collision cell that includes N quadrupole arrays (not shown) that eject ions from the collision cell through an exit lens with N exit apertures.

ELIT 320 includes N entrance apertures. ELIT 320 receives ions from only one of the N beams of ions from beam splitter 310 at each entrance aperture of the N entrance apertures. ELIT 320 traps ions from each entrance aperture of the N entrance apertures in separate linear flight paths, producing N separate linear flight paths. ELIT 320 measures ion oscillations in the N separate linear flight paths at substantially the same time.

In various embodiments, ELIT 320 further includes first concentric mirror 330 with one or more electrodes, second concentric mirror 340 with one or more electrodes, and image current detector 350 between first concentric mirror 330 and second concentric mirror 340. In the cross-sectional side view of FIG. 3, only two entrance apertures 321 and 322 of ELIT 320 are shown. However, ELIT 320 includes N entrance apertures to receive the N beams of ions from beam splitter 310. The N entrance apertures of ELIT 320 are linearly aligned with the N exit apertures of beam splitter 310. For example, as shown in FIG. 3, entrance aperture 321 is linearly aligned with exit aperture 312, and entrance aperture 322 is linearly aligned with exit aperture 313.

Each electrode of first concentric mirror 330 includes N apertures, each electrode of second concentric mirror 340 includes N apertures, and image current detector 350 includes N apertures. Again, because FIG. 3 is a cross-sectional side view, only two apertures are shown in each electrode of first concentric mirror 330, each electrode of the second concentric mirror 340, and image current detector 350. For example, electrode 331 of first concentric mirror 330 has two apertures and electrode 341 of second concentric mirror 340 has two apertures.

The N apertures of each electrode of first concentric mirror 330, the N apertures of each electrode of second concentric mirror 340, and the N apertures of image current detector 350 are linearly aligned with the N entrance apertures to provide N separate linear ion flight paths. In the cross-sectional side view of FIG. 3, two separate linear ion flight paths 361 and 362 are shown. However, ELIT 320 produces N separate linear ion flight paths.

Each entrance aperture of the N entrance apertures of ELIT 320 receives ions from only one of the N beams of ions of beam splitter 310. Image current detector 350 measures ion oscillations between first concentric mirror 330 and the second concentric mirror 340 in the N separate linear ion flight paths. ELIT 320 provides multiplex analysis, because image current detector 350 measures the ion oscillations of the N separate linear ion flight paths at substantially the same time. For example, as shown in FIG. 3, image current detector 350 measures the ion oscillations of flight path 361 and flight path 362 at substantially the same time.

Image current detector 350 is, for example, one detector that measures the image current from its N apertures. In various alternative embodiments, image current detector 350 can include two or more separate detectors. For example, image current detector 350 can include N separate detectors that measure N separate image currents at the N apertures of image current detector 350. The N separate image currents from the N separate detectors are combined using a processor (not shown), for example. The processor can be, but is not limited to, a computer, microprocessor, or any device capable of sending and receiving control signals and data from a mass analyzer and processing data.

In various embodiments, the N apertures of each electrode of first concentric mirror 330, the N apertures of each electrode of second concentric mirror 340, and the N apertures of image current detector 350 are evenly spaced along and centered on a circumference of a circle.

Figure 4:
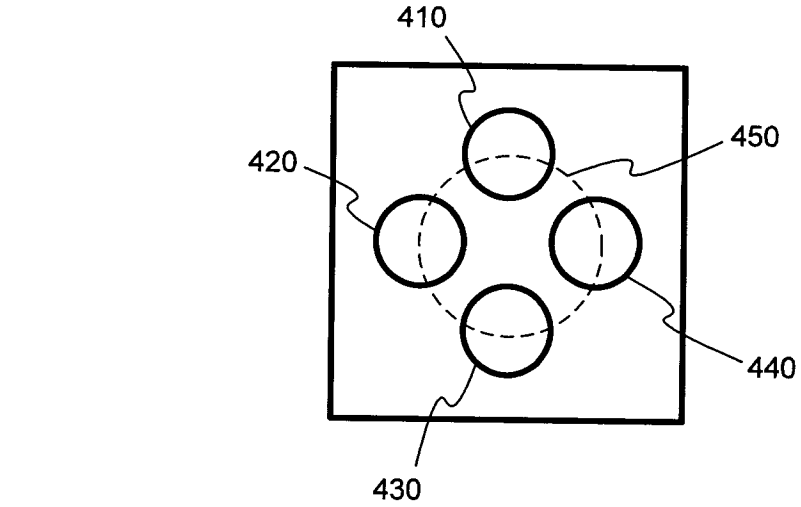
FIG. 4 is a cross-sectional front view of an electrode of a concentric mirror of a multiplex ELIT, in accordance with various embodiments.

FIG. 4 is a cross-sectional front view of an electrode 400 of a concentric mirror of a multiplex ELIT, in accordance with various embodiments. Electrode 400 is a plate with four apertures 410, 420, 430, and 440. Ions pass through apertures 410, 420, 430, and 440 as they are reflected in their separate flight paths. Apertures 410, 420, 430, and 440 are evenly spaced along and centered on the circumference of an imaginary circle 450, for example. Electrode 400 can be electrode 331 or 342 of FIG. 3, for example.

Returning to FIG. 3, in various embodiments, the N apertures of each electrode of first concentric mirror 330, the N apertures of each electrode of second concentric mirror 340, and the N apertures of image current detector 350 are aligned so the ions in each of the N separate linear ion flight paths have the same phase. For example, the ions in flight path 361 and flight path 362 have the same phase.

Method for Multiplex Electrostatic Linear Ion Trap Mass Spectrometry

Figure 5:
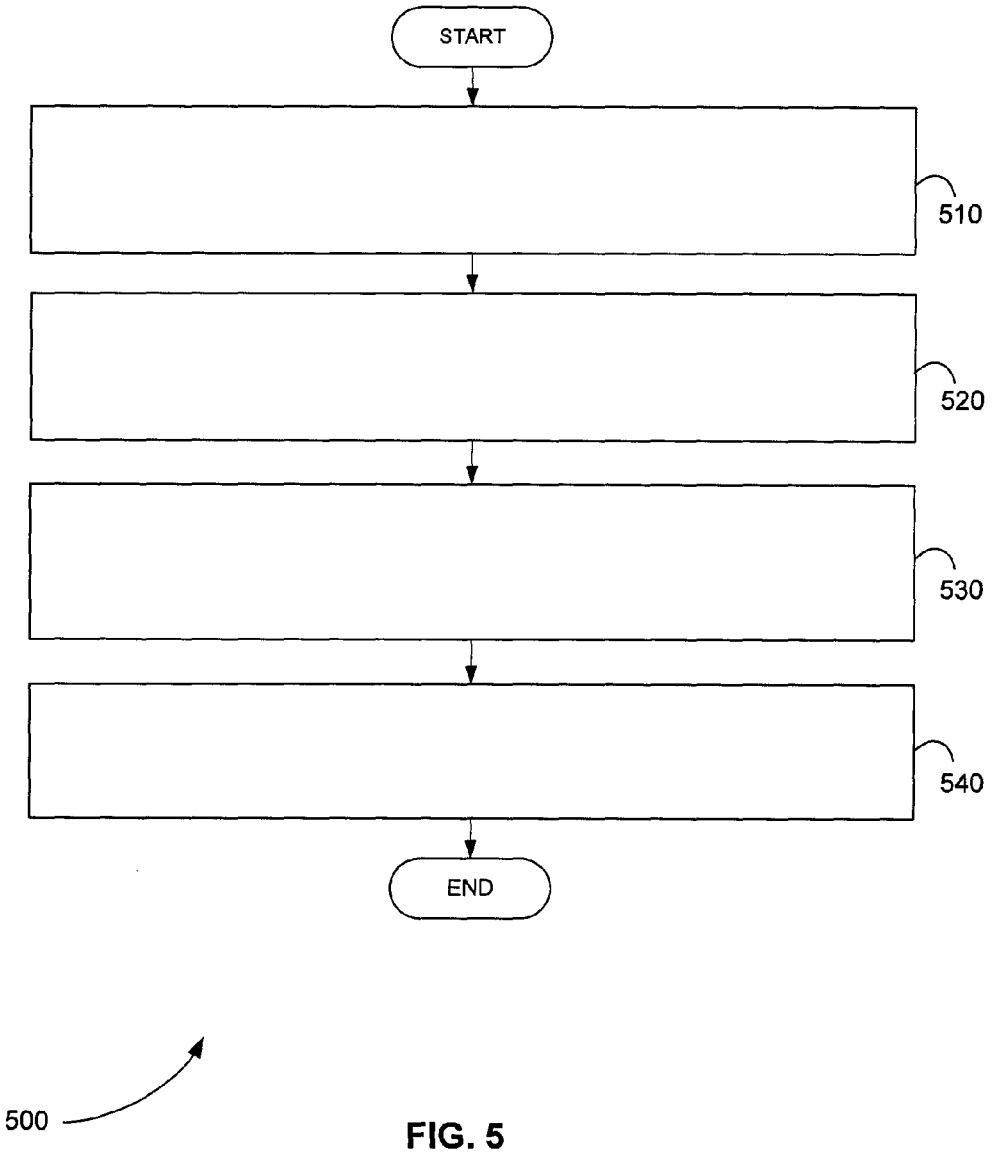
FIG. 5 is a flowchart showing a method for performing multiplex electrostatic linear ion trap mass spectrometry, in accordance with various embodiments.

FIG. 5 is a flowchart showing a method 500 for performing multiplex electrostatic linear ion trap mass spectrometry, in accordance with various embodiments.

In step 510 of method 500, a first beam of ions is received and the first beam is split into N beams of ions using a beam splitter. N is two or more.

In step 520, ions are received from only one of the N beams of ions at each entrance aperture of N entrance apertures of an electrostatic linear ion trap.

In step 530, ions from each entrance aperture of the N entrance apertures are trapped in separate linear flight paths using the electrostatic linear ion trap, producing N separate linear flight paths.

In step 540, ion oscillations in the N separate linear flight paths are measured at substantially the same time using the electrostatic linear ion trap.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A mass analyzer for performing multiplex electrostatic linear ion trap mass spectrometry, comprising:

a beam splitter that receives a beam of ions and splits the beam into N beams of ions, wherein N is two or more; and an electrostatic linear ion trap with N entrance apertures that receives ions from only one of the N beams of ions at each entrance aperture of the N entrance apertures, traps ions from each entrance aperture of the N entrance apertures in separate linear flight paths, producing N separate linear flight paths; and measures ion oscillations in the N separate linear flight paths at substantially the same time.

2. The mass analyzer of claim 1, wherein the beam splitter splits the beam into N beams of ions so that the number of ions in each of the N beams of ions is less than the number of ions in the beam.

3. The mass analyzer of claim 1, wherein the electrostatic linear ion trap further includes a first concentric mirror with one or more electrodes, a second concentric mirror with one or more electrodes, and an image current detector between the first concentric mirror and the second concentric mirror and wherein each electrode of the first concentric mirror includes N apertures, each electrode of the second concentric mirror includes N apertures, and the image current detector includes N apertures.

4. The mass analyzer of claim 3, wherein the N apertures of each electrode of the first concentric mirror, the N apertures of each electrode of the second concentric mirror, and the N apertures of the image current detector are linearly aligned with the N entrance apertures to produce the N separate linear ion flight paths.

5. The mass analyzer of claim 4, wherein the image current detector measures ion oscillations between the first concentric mirror and the second concentric mirror in the N separate linear ion flight paths at substantially the same time.

6. The mass analyzer of claim 1, wherein the beam splitter is part of the electrostatic linear ion trap.

7. The mass analyzer of claim 1, wherein the beam splitter comprises a collision cell that includes N quadrupole arrays that eject ions from the collision cell through an exit lens with N apertures.

8. The mass analyzer of claim 3, wherein the N apertures of each electrode of the first concentric mirror, the N apertures of each electrode of the second concentric mirror, and the N apertures of the image current detector are evenly spaced along and centered on a circumference of a circle.

9. The mass analyzer of claim 3, wherein the N apertures of each electrode of the first concentric mirror, the N apertures of each electrode of the second concentric mirror, and the N apertures of the image current detector are aligned so the ions in each of the N separate linear ion flight paths have the same phase.

10. A method for performing multiplex electrostatic linear ion trap mass spectrometry, comprising:

receiving a first beam of ions and splitting the first beam into N beams of ions using a beam splitter, wherein N is two or more;

receiving ions from only one of the N beams of ions at each entrance aperture of N entrance apertures of an electrostatic linear ion trap;

trapping ions from each entrance aperture of the N entrance apertures in separate linear flight paths using the electrostatic linear ion trap, producing N separate linear flight paths; and measuring ion oscillations in the N separate linear flight paths at substantially the same time using the electrostatic linear ion trap.

11. The method of claim 10, wherein the beam splitter splits the beam into N beams of ions so that the number of ions in each of the N beams of ions is less than the number of ions in the beam.

12. The method of claim 10, wherein wherein the electrostatic linear ion trap further includes a first concentric mirror with one or more electrodes, a second concentric mirror with one or more electrodes, and an image current detector between the first concentric mirror and the second concentric mirror and wherein each electrode of the first concentric mirror includes N apertures, each electrode of the second concentric mirror includes N apertures, and the image current detector includes N apertures.

13. The method of claim 12, wherein wherein the N apertures of each electrode of the first concentric mirror, the N apertures of each electrode of the second concentric mirror, and the N apertures of the image current detector are linearly aligned with the N entrance apertures to produce the N separate linear ion flight paths.

14. The method of claim 13, wherein the image current detector measures ion oscillations between the first concentric mirror and the second concentric mirror in the N separate linear ion flight paths at substantially the same time.

15. The method of claim 10, wherein the beam splitter is part of the electrostatic linear ion trap.

16. The method of claim 10, wherein the beam splitter comprises a collision cell that includes N quadrupole arrays that eject ions from the collision cell through an exit lens with N apertures.

17. The method of claim 12, wherein the N apertures of each electrode of the first concentric mirror, the N apertures of each electrode of the second concentric mirror, and the N apertures of the image current detector are evenly spaced along and centered on a circumference of a circle.

18. The method of claim 12, wherein the N apertures of each electrode of the first concentric mirror, the N apertures of each electrode of the second concentric mirror, and the N apertures of the image current detector are aligned so the ions in each of the N separate linear ion flight paths have the same phase.

* * * * *